US009808831B2

(12) United States Patent
Scheid

(10) Patent No.: US 9,808,831 B2
(45) Date of Patent: Nov. 7, 2017

(54) AUTOMATIC SHAKER SCREEN CLEANER

(71) Applicant: KAMAKO MANUFACTURING, LLC, Chatsworth, CA (US)

(72) Inventor: David Scheid, Chatsworth, CA (US)

(73) Assignee: KAMAKO MANUFACTURING, LLC, Chatsworth, CA (US)

( * ) Notice: Subject to any disclaimer, the term of this patent is extended or adjusted under 35 U.S.C. 154(b) by 546 days.

(21) Appl. No.: 14/072,627

(22) Filed: Nov. 5, 2013

(65) Prior Publication Data

US 2015/0122296 A1 May 7, 2015

(51) Int. Cl.
*B07B 1/55* (2006.01)

(52) U.S. Cl.
CPC ..... *B07B 1/55* (2013.01)

(58) Field of Classification Search
CPC .. B07B 1/55; B07B 1/50; B08B 13/00; B08B 15/00; B08B 5/02; E21B 37/08
USPC ..... 134/198; 239/146, 159, 225.1, 270, 722, 239/726, 734, 737, 739
See application file for complete search history.

(56) References Cited

U.S. PATENT DOCUMENTS 5,218,986 A * 6/1993 Farwell ..... 137/14
6,167,965 B1 * 1/2001 Bearden et al. ..... 166/250.15
7,740,021 B2 * 6/2010 Baker ..... 134/148

OTHER PUBLICATIONS

Aerion Screen Cleaners, http://www.aerionrentals.com/screen-cleaners.htm.
Rigtools Shaker Screen Clean Machine, http://www.rigtools.net/shaker-screen-clean-machine.
How to Clean the Shaker Screens, http://oilfield.gnsolidscontrol.com/how-to-clean-the-shaker-screens/.
Chalmers Shaker Screen Cleaning System, http://publications.lib.chalmers.se/records/fulltext/175360/175360.pdf.
Shaker Screen Clean Machine, http://www.globaloffshore.eu/index.php?id=75.

* cited by examiner

*Primary Examiner* — Michael Barr
*Assistant Examiner* — Rita Adhlakha
(74) *Attorney, Agent, or Firm* — Fabiano Law Firm, P.C.; Michael D. Fabiano

(57) ABSTRACT

The Automatic Shaker Screen Cleaner of this invention enables the efficient cleaning of the large shaker screens that are often used in petroleum extraction and mining operations. This Automatic Shaker Screen Cleaner includes a pump system to deliver water or solvent fluid to clean the shaker screens; a motor system to move the cleaning apparatus back and forth to facilitate the cleaning of the shaker screens; a pressurized air system to clean the hoses when the device is not in use, as well as the electronic controls and power connections required to safely operate the Cleaner.

7 Claims, 7 Drawing Sheets

AUTOMATIC SHAKER SCREEN CLEANER

BACKGROUND OF THE INVENTION

The present invention relates to the cleaning of shaker screens often used in petroleum extraction and mining operations, particularly to a device for the automatic cleaning of said shaker screens that allows the screens to be cleaned more efficiently and safely than with current "manual" cleaning methods.

Large screens known in the petroleum and mining businesses as shaker screens are used to filter out rocks and debris that accumulate during drilling or mining. In order for the screens to keep filtering properly, the screens must be cleaned to remove the accumulated debris. That cleaning is usually done manually, in present petroleum and mining operations, by personnel who manually use high-pressure hoses to wash the debris off of the screens. Alternatively, the shaker screens can be removed from the drilling or mining apparatus and cleaned in a separate device that is essentially a large dishwasher. The present invention is an improvement over both manual cleaning and the "dishwasher" type of screen cleaners, in that it enables automatic cleaning of the shaker screens, while active drilling or mining operations are going on, and that is both safer and more efficient. Further improvements of the present invention over manual cleaning are that it uses less fluid pressure on the screens, resulting in less damage to the shaker screens, that the present invention's downward spray system reduces the spray of potentially hazardous cleaning fluids, and does not require a worker to leave his or her current job task in order to clean the screens.

SUMMARY OF THE INVENTION

The automatic shaker screen cleaner of this invention is designed to complete the task of cleaning screens, such as on an oil rig shaker or in a mining operation, while active extraction operations are going on. In a preferred embodiment, the operator can use preset functions to set the on and "off" time of the unit as well as how many cleaning passes the spray transport will complete during the on time; when the unit is "on", the electric motor powers all of the systems and the spray transport moves the spray nozzle bar back and forth along the shaker screens, cleaning the drilling debris from the screens based on the timing functions preset by the operators, and the unit will continue to run automatically throughout the drilling process, turning on and off based on operator set up, cleaning the screens without the need for human intervention.

A principal objective of this invention is enabling automatic cleaning of shaker screens while oil drilling or mining extraction are in progress, so that the screens do not to be cleaned manually (which requires extra worker time and can be less safe for workers than automatic cleaning) and the extraction process does not need to be halted for screen removal and cleaning.

Another objective of this invention is to minimize damage to the screens when cleaning. A further objective is to reduce the spray of potentially hazardous cleaning fluids and to minimize waste of cleaning fluids.

These and other advantages of this invention appear in the following detailed description and the accompanying drawings of the preferred embodiments.

DESCRIPTION OF THE PREFERRED EMBODIMENTS

Figure 1B:
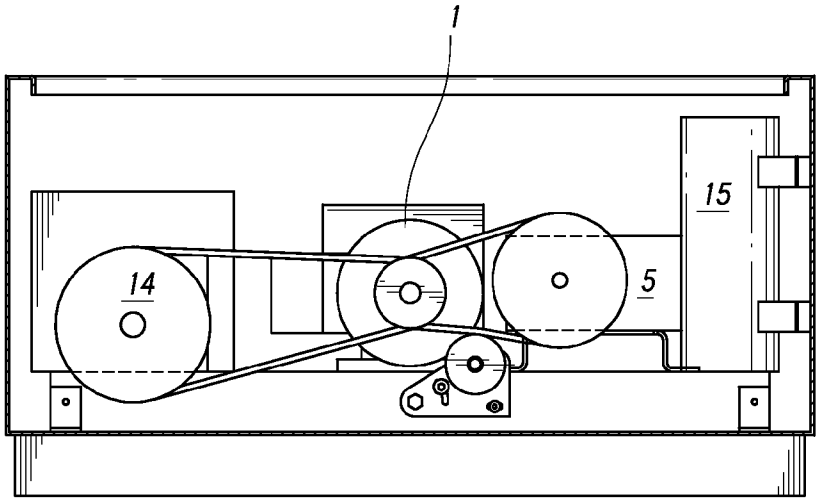
FIG. 1B is an overview of the main enclosure showing all the major systems and parts from a side view.
Figure 1A:
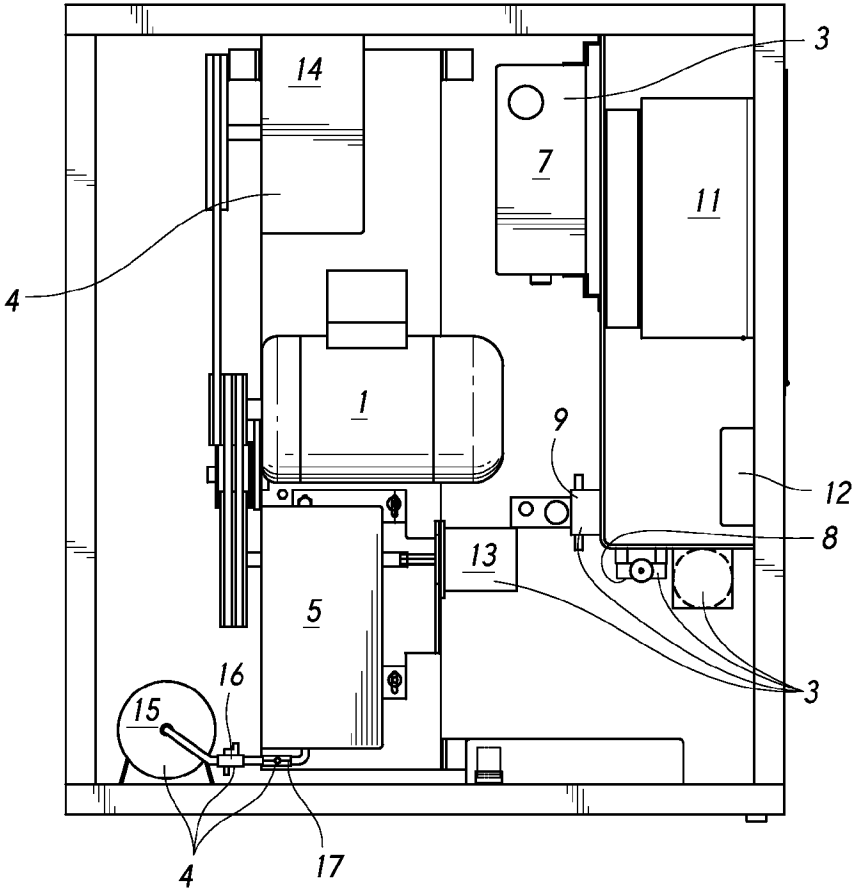
FIG. 1A is an overview of the main enclosure showing all the major systems and parts from a top view.
Figure 2B:
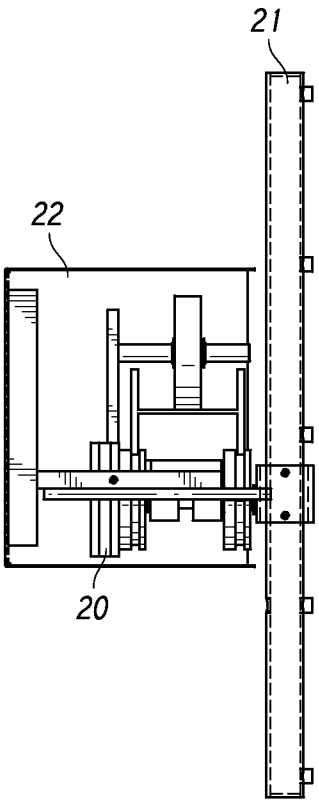
FIGS. 2A, 2B, 2C, and 2D are diagrams showing the standard sprayer transport, support beam, and universal mounting bracket.
Figure 2A:
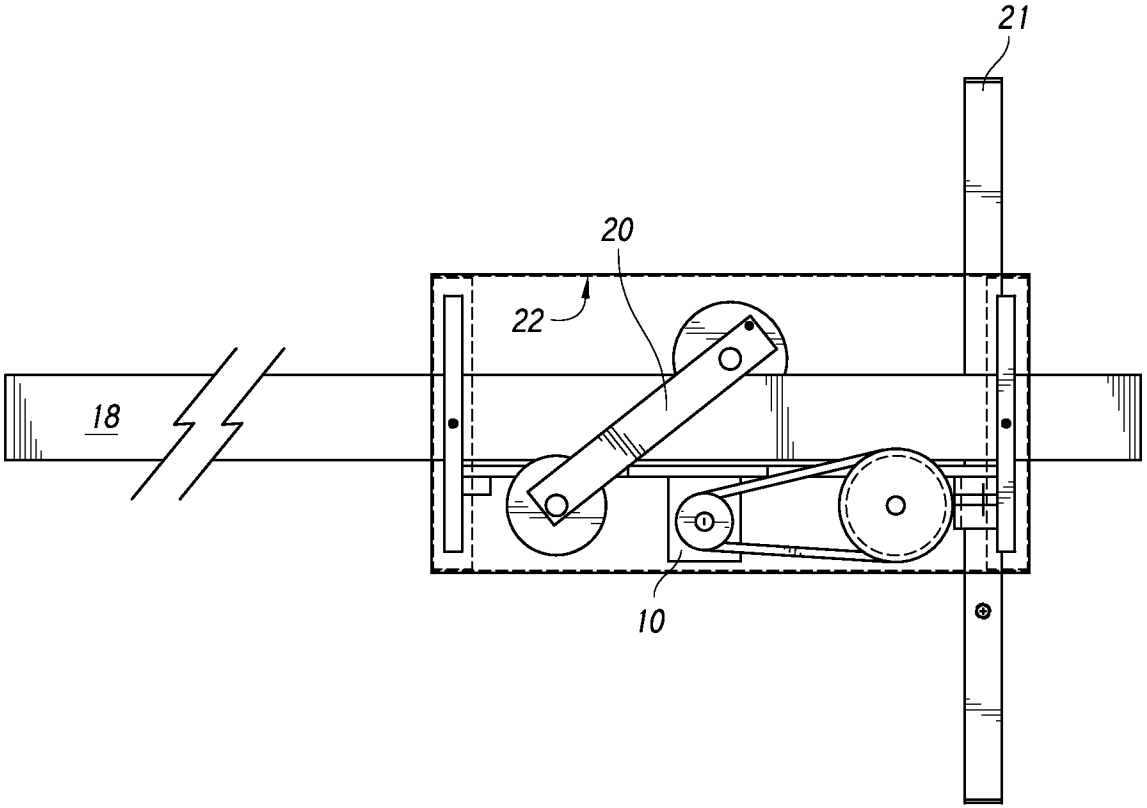
Figure 2C:
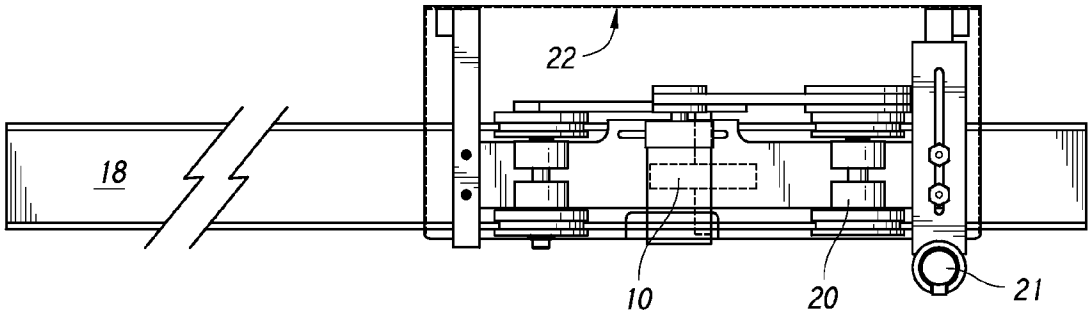
Figure 2D:
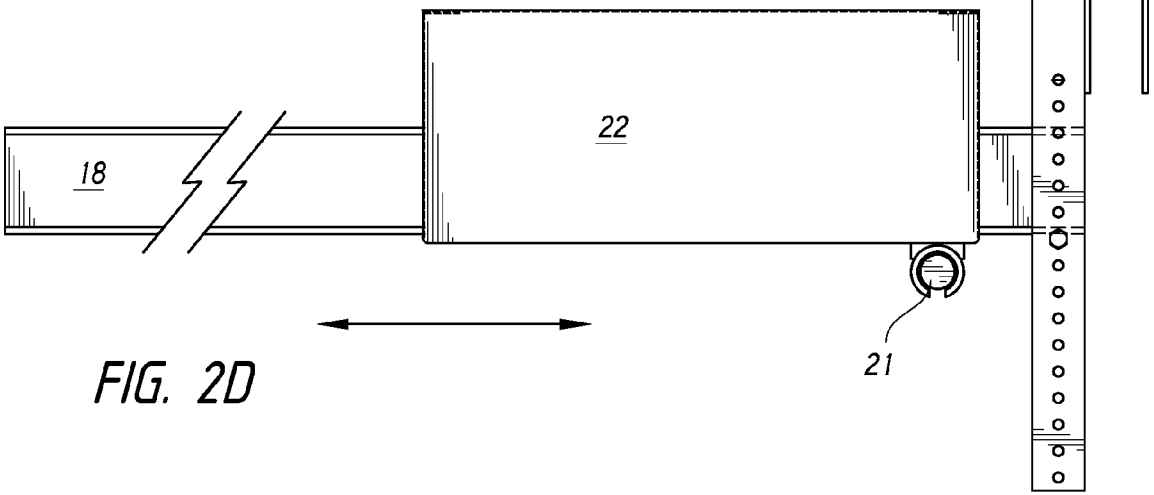
Figure 3B:
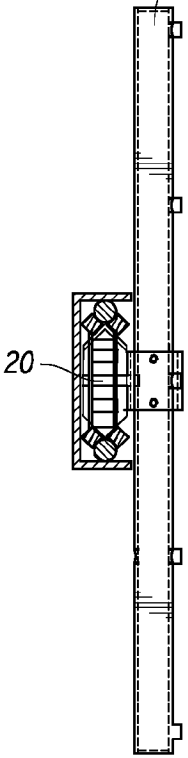
FIGS. 3A, 3B, 3C, and 3D are diagrams showing the low profile sprayer transport, support beam, and universal mounting bracket.
Figure 3A:
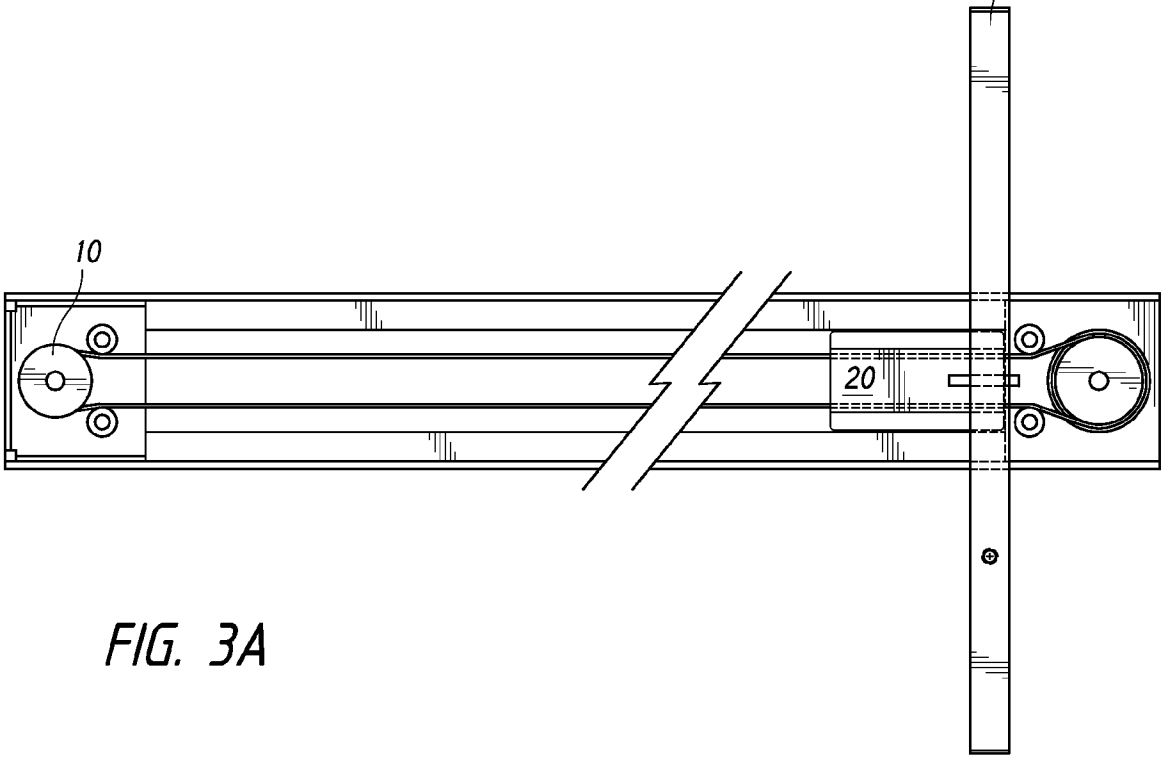
Figure 3C:
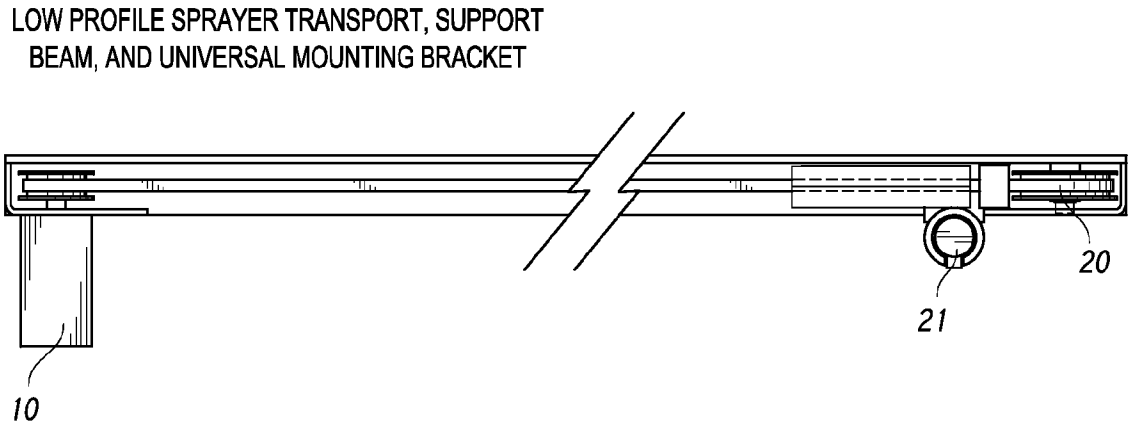
Figure 3D:
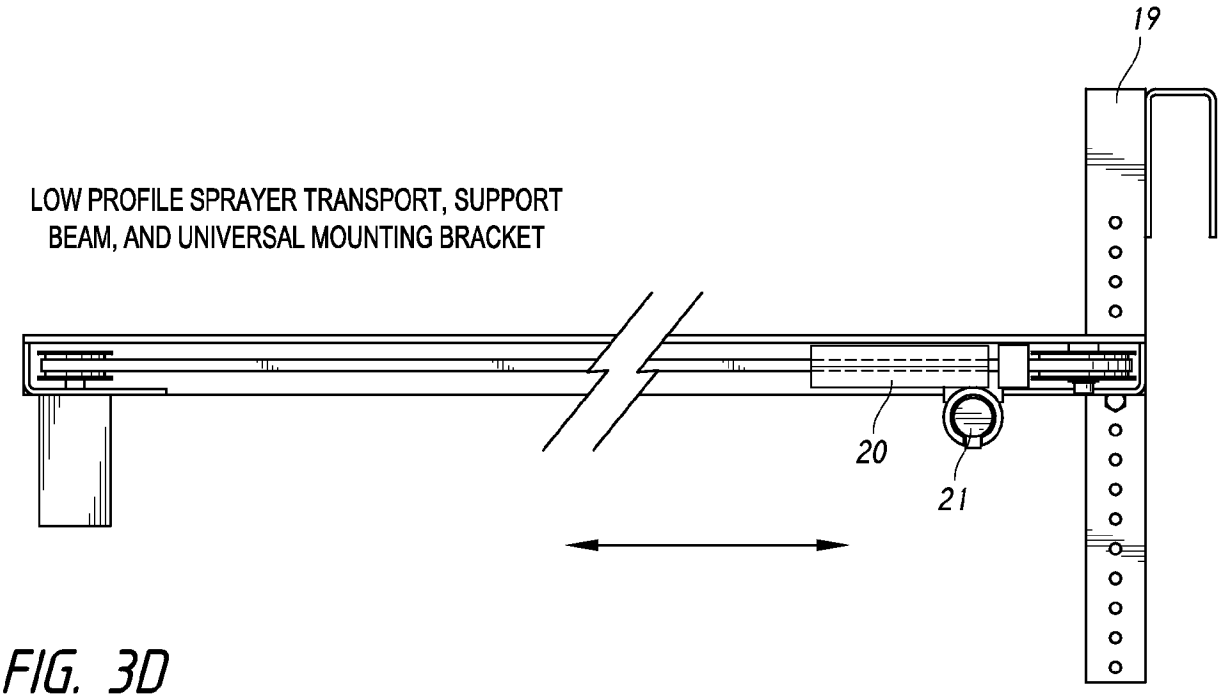
Figure 4:
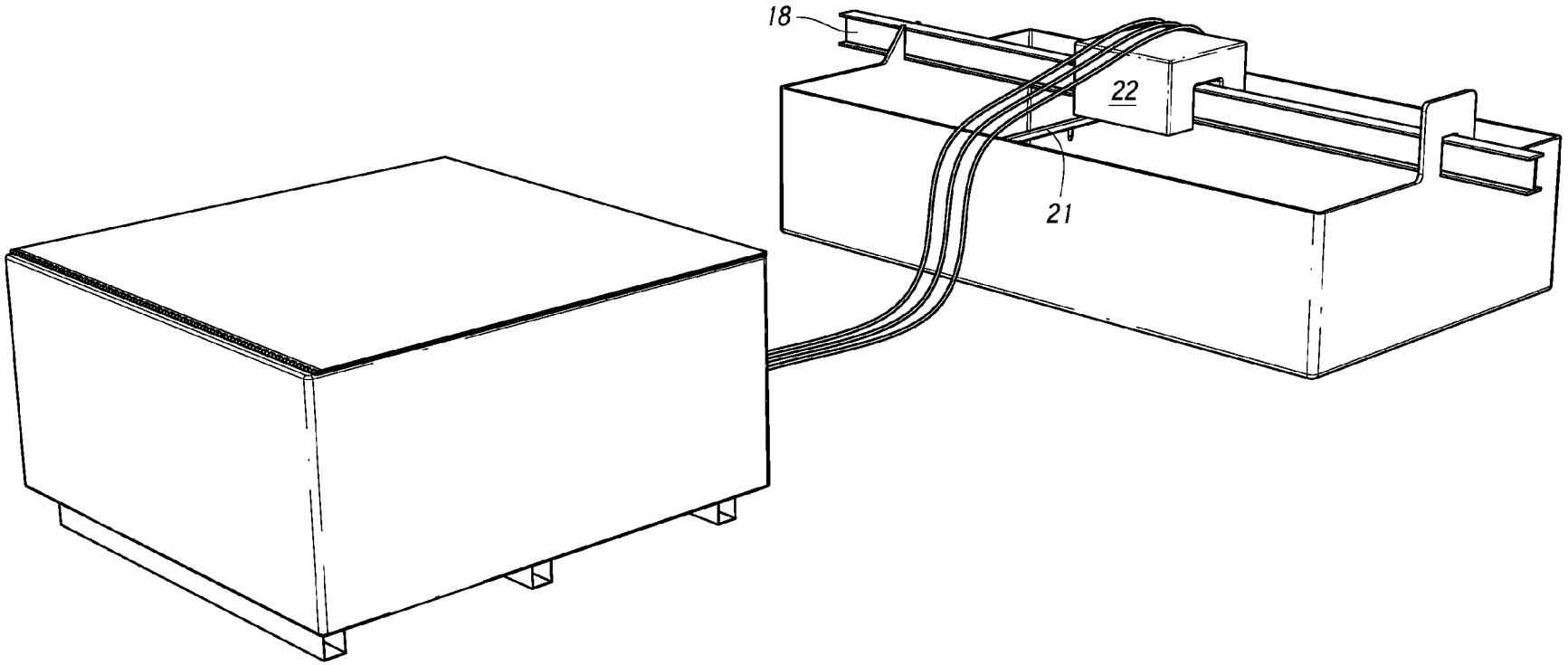
FIG. 4 is a diagram showing the main enclosure with hoses attached to the remote sprayer transport, which is in turn mounted on a test tank, simulating a shaker screen in the manufacturing environment
Figure 5:
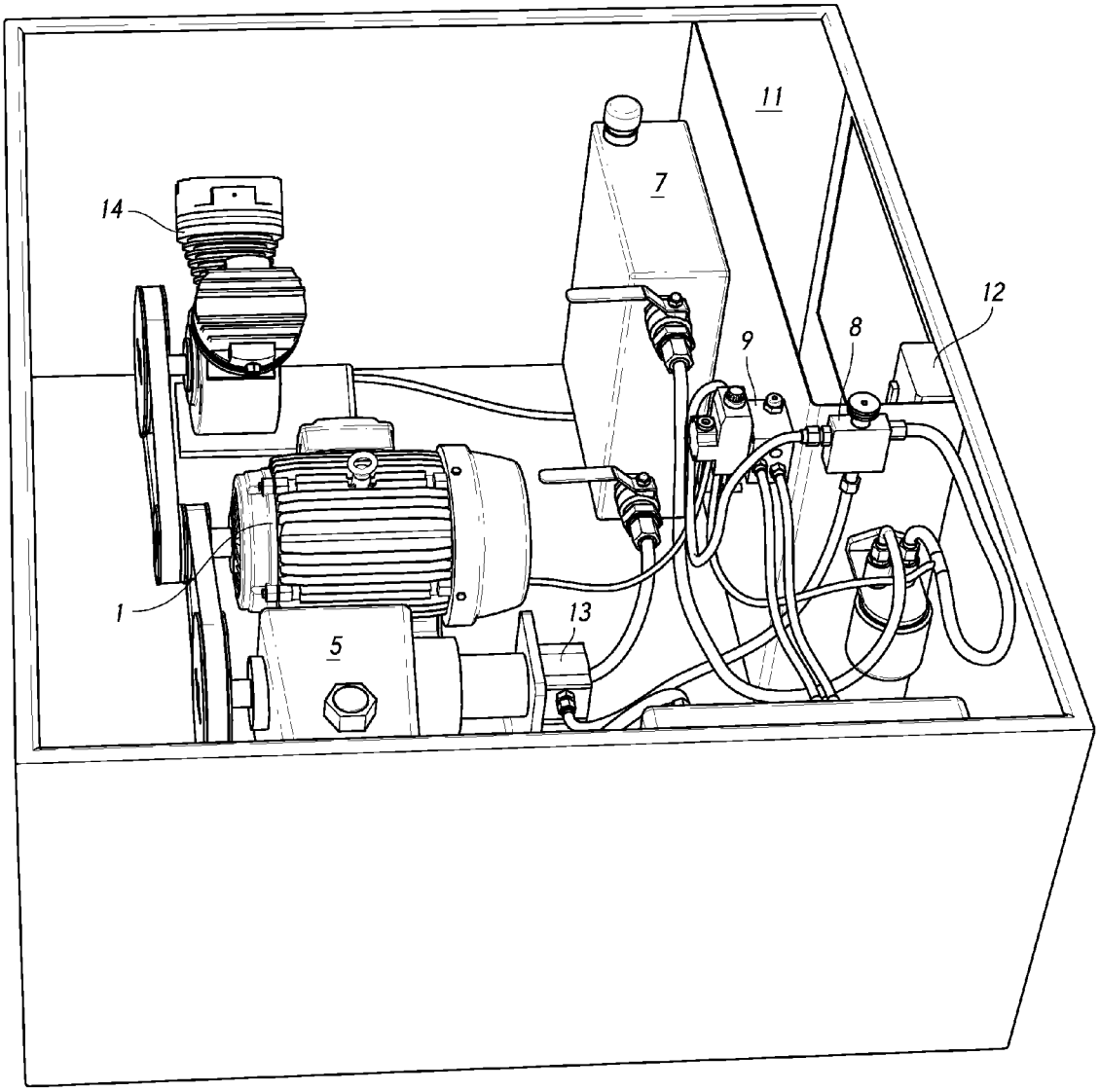
FIG. 5 is a diagram showing a top view of the components inside the main enclosure.

As used herein with the various illustrated embodiments described below, the following terms include, but are not limited to, the following meanings.

The term "shaker screen" means the existing equipment on the drilling site that the invention is meant to clean.

The term "enclosure" means the ¼" thick aluminum case that holds the various systems necessary for operation of the device.

The term "sprayer transport" means the apparatus remote from the enclosure that cleans the shaker screens.

The term "cleaning solution" means any solution used by the device to clean the shaker screen, typically water or diesel solvent.

The term "pump system" means the components of the device necessary to pump cleaning solution to the sprayer transport.

The term "hydraulic system" means the components of the device necessary to move the sprayer transport along the length of the shaker screen.

The term "pressurized air system" means the components of the device necessary to remove the cleaning solution from the hoses.

The term "electronic controls" means the components of the device necessary to control and monitor all the systems of the invention.

The term "power connection" means the components of the device necessary to provide the electrical power required to operate the invention.

In a preferred embodiment of the invention, the entire structure is powered by a single electric motor (1), with power of 480 volt AC or equivalent to a total of at least 8 horsepower. This motor powers the Pump System, the Hydraulic System (3), and the Pressurized Air System (4). One advantage of a single motor is to be assured that if the motor should fail, then all systems will cease to operate. This feature requires maintenance to be performed before operation can resume, thus avoiding a potential hazard that might arise from any of the systems of the device operating independently.

Preferably, the Pump System consists of a 13 gallon per minute pump, such as (5), and the hoses needed to connect the pump to the sprayer transport. The pump is preferably capable of producing between 300 and 1500 psi of pressure, at a rate that would feed the required number of spray tips, while pumping the cleaning solution to the sprayer transport (6). The pump is driven by the electric motor using a twin drive belt system to insure stability during operation.

The Hydraulic System (3) consists of a reservoir tank (7) to hold the hydraulic fluid, a hydraulic pump (13) to move the fluid through the system, a flow control valve (8) to control the pressure of the fluid as it moves through the system, a directional valve (9) to reverse the flow of the fluid, a filter, and a hydraulic motor (10) mounted to the sprayer transport (6). The hydraulic system (3) operates at a pressure (200-400 psi in a preferred embodiment) required to achieve the power necessary to move the sprayer transport (6), while the flow control valve (8) will control the speed at which the spray transport moves across the shaker screen. The directional valve (9) will change the direction of hydraulic fluid flow as necessary to change the direction of movement of the sprayer transport (6).

The Pressurized Air System (4) consists of an air compressor pump (14), an air compressor tank (15), an unloader valve (16), and a one way check valve (17). The air compressor pump (14) is driven by the electric motor (1) using a single belt configuration. The pressurized air system (4) builds pressure in the tank to approximately 150 psi. When pressure in the system begins to reach 150 psi, the unloader valve (16) will release pressure in the system into the atmosphere in order to maintain a constant safe pressure in the system. When the pressure in the pump system falls below 150 psi, signifying that cleaning fluid is no longer being pumped, the check valve (17) will open, allowing the pressurized air to blow out the fluid lines as necessary in order to prevent freezing in the lines during cold weather operation.

The sprayer transport (6) consists of an I-beam transport bar (18), a universal mounting bracket (19), a transport assembly (20), a spray bar (21), and a transport cover (22). The I-beam transport bar (18) is installed using the universal mounting bracket across the entire length of the shaker screen. The sprayer transport (6) is then installed on the transport bar (18) via a spring loaded tensioner that holds the assembly to the transport bar and provides the necessary tension for the transport assembly (20) to move across the bar. The spray bar (21) preferably consists of five or seven 0.2 gallon per minute nozzles as required by each shaker screen model. The sprayer angle may preferably be 15 to 60 degrees as required by each shaker screen model.

In a preferred embodiment, the sprayer transport mechanism has two possible configurations, one being the standard model that will operate on all shaker screen models without covers and a low profile model that can operate on shaker screen models with covers or on stacked shaker screen models that have limited headroom between the upper and lower shaker screens. This configuration will employ a C-channel transport bar. However, the sprayer transport mechanism has many possible configurations, including that the spray transport could be chain driven, or belt driven, or could work on a slide that moves via pressure created from the spray pump.

The sprayer transport preferably connects remotely to the enclosure via two hoses, each 100 feet in length, and one 100 foot cleaning fluid hose. Each enclosure can operate up to three sprayer transports, thus allowing a single shaker screen cleaner to clean up to three shaker screens. The hose could alternatively be of other convenient lengths and could power any number of sprayer transports, given an adequate pump and motor combination, up to a pressure that is not so high as to damage the spray screens themselves.

The preferable cleaning fluid pressure for 1-3 spray bars in the preferred embodiment is between 200-800 psi.

The electronic controls (11), in a preferred embodiment, consist of an explosion proof (Class 1 Division 2, Zone 1 ATEX) housing for the electronics, a starter switch for the motor, timer circuitry, and supporting electronics. Starting may be effected by a manual switch or automatically via a programmable logic controller (PLC) controlled starter; both are included in the electrical controls in a preferred embodiment. The timer circuitry controls at what interval the shaker screen is cleaned, the duration of the cleaning cycle during this interval, and also for the sprayer transport as it travels the length of the shaker screen. These parameters can be programmed into the PLC controlled starter mechanism or can be set using discreet components as required per customer request. The supporting electronics consist of a step down transformer, fuses, and associated wiring necessary for operation.

The power connection (12) preferably consists of approximately 100 feet of SO 10/4 electrical cable, explosion proof Class 1 Zone 1 plugs attached to each end of the cable, and an explosion proof (Class 1 Zone 1) receptacle mounting on the enclosure. The power connection is suitable for hazardous area duty and can deliver the 480 volts AC @ 30 amps to the enclosure necessary for proper and safe operation of the invention.

Preferably, the components are corrosion-resistant, and are not intended, separately or as assembled, to be submersed.

The various components are preferably designed to work in hazardous conditions, including but not limited to oil rig drilling sites, mining operations, extreme cold, and extreme heat. All electrical devices that make or break electrical connections are preferably either housed in the explosion proof control housing or the components themselves are rated as explosion proof from the manufacturer.

The power cable will preferably be connected to local power at the work site and to the device of the invention. The cable is preferably constructed using 2 types of connecters, one being the standard APC connection common in oil and mining operations, the other being a CPH connection that mates with the receptacle on the invention device. This is to insure the proper cable is used to power the device of this invention. It is possible to have the device enclosure preferably up to 100 feet from the power source as necessary.

The sprayer transport and the transport bar will be installed on the shaker screen and connected to the enclosure via the proper hoses and power cord (including 2 hydraulic hoses and the cleaning solution hose in a preferred embodiment). It is possible to have the enclosure up to 100 feet or more from the shaker screen as necessary.

Once the device is powered on and in the auto position, the starter switch will preferably start the electric motor and all systems will be operational as the motor comes up to full speed. The device will then begin the operation of cleaning the shaker screen at the interval programmed on the PLC, or via the discreet timers as the customer requires. A typical cleaning cycle preferably would run the sprayer transport back and forth 1-4 times along the transport bar, taking approximately 11-30 seconds for each length of the transport bar to clean the shaker screens. The device preferably would then shut down for 5-30 minutes, and the process would be repeated during the drilling or mining operation.

When the device is powered up, in the preferred embodiment, the following will take place simultaneously:

The hydraulic system will begin to pump fluid through the hydraulic hoses at a flow rate necessary to support an interval of approximately 11-30 seconds for the sprayer transport to traverse the transport bar. When the timer controlling the sprayer transport has run for approximately 11-30 seconds per direction, then the sprayer transport will reverse direction.

The pump system will begin to pump cleaning solution to the spray bars located on the sprayer transport. Each spray bar will preferably contain 5 or 7 nozzles, and will provide a downward spray of approximately 200-800 psi as the sprayer transport moves across the shaker screen, cleaning debris from the shaker screen.

The pressurized air system will begin to fill the air tank to an appropriate pressure to purge the lines, approximately 150 psi in a preferred embodiment, and hold that pressure in the system until the cleaning cycle has ended.

When the cleaning cycle has ended, the device will preferably shut off, and when the pressure in the pump system falls below approximately 150 psi, the check valve will open and the pressurized air system will blow air through the cleaning solution hoses in order to evacuate all the fluid, thereby eliminating the possibility of cleaning fluid freezing in the hoses.

It will be apparent to those skilled in the art that various modifications and changes to the structures, dimensions, and features described herein may be made without departing from the spirit of the invention and the scope of the appended claims.

What is claimed is:

1. A device comprising:

a. An electronic control box that includes a programmable logic controller;

b. A soft starter;

c. A power valve;

d. A hydraulic directional valve;

e. One or more electric motors;

f. A pressure pump;

g. An air compressor pump;

h. A hydraulic pump;

i. A priority control valve, said priority control valve controlling the pressure of the hydraulic fluid;

j. A hydraulic tank and filter, said tank holding hydraulic fluid that is cleaned by passing through said filter;

k. Hydraulic and pressure hoses of sufficient length;

l. A sprayer transport comprising a hydraulic motor, a roller system, and at least one spray bar, said spray bar containing two or more spray nozzles that spray fluid on a shaker screen;

wherein said electronic control box, soft starter, power valve, hydraulic directional valve, electric motor or motors, pressure pump, air compressor pump, hydraulic pump, priority control valve, and hydraulic tank and filter are housed in an enclosure;

wherein the sprayer transport is connected to a shaker screen and further connected to said enclosure via the hydraulic hoses and pressure hose, enabling cleaning fluid to be sprayed from the spray nozzles onto said shaker screen;

wherein the electric motor or motors powers the pressure pump, the air compressor pump, and the hydraulic system; and wherein said device is capable of being attached directly to a drilling or mining apparatus and cleaning a shaker screen while said shaker screen remains installed in said drilling or mining apparatus.

2. The device of claim 1, wherein the electric motor or motors has at least 8 total horsepower.

3. The device of claim 1, wherein each spray bar contains 5 or more spray nozzles.

4. The device of claim 1, wherein the device is capable of producing at least 300 psi of fluid pressure from the spray nozzles.

5. The device of claim 1, 3, or 4, wherein the cleaning fluid sprayed onto a shaker screen is diesel solvent.

6. The device of claim 1, 3, or 4, wherein the cleaning fluid sprayed onto a shaker screen is a hydrocarbon solvent.

7. The device of claim 1, 3, or 4, wherein the cleaning fluid sprayed onto a shaker screen is an alcohol-based, ester-based, or ketone-based solvent.

* * * * *